US011339941B2

(12) United States Patent
Liu

(10) Patent No.: US 11,339,941 B2
(45) Date of Patent: May 24, 2022

(54) SURFACE LIGHT EMITTING MODULE FOR LED LIGHT SOURCE, VEHICLE LAMP USING THE SAME, AND METHOD OF ASSEMBLING THE SAME

(71) Applicant: HASCO VISION TECHNOLOGY CO., LTD., Shanghai (CN)

(72) Inventor: Xiyuan Liu, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 401 days.

(21) Appl. No.: 16/320,737

(22) PCT Filed: Aug. 17, 2018

(86) PCT No.: PCT/CN2018/100954
§ 371 (c)(1),
(2) Date: Jan. 25, 2019

(87) PCT Pub. No.: WO2019/227688
PCT Pub. Date: Dec. 5, 2019

(65) Prior Publication Data

US 2020/0408379 A1 Dec. 31, 2020

(30) Foreign Application Priority Data

May 31, 2018 (CN) ..... 201810554222.6
Aug. 3, 2018 (CN) ..... 201810893557.0

(51) Int. Cl.
*F21S 43/145* (2018.01)
*F21S 43/239* (2018.01)
(Continued)

(52) U.S. Cl.
CPC ..... *F21S 43/145* (2018.01); *F21S 43/239* (2018.01); *F21S 43/241* (2018.01); *F21S 43/245* (2018.01);
(Continued)

(58) Field of Classification Search
CPC ..... F21S 43/145; F21S 43/239; F21S 43/245; F21S 43/241; F21V 19/0025; F21Y 2115/15; F21W 2103/10
See application file for complete search history.

(56) References Cited

U.S. PATENT DOCUMENTS 9,389,359 B2 7/2016 Hsiao et al.
2007/0103936 A1* 5/2007 Yue ..... G02B 6/002 362/613
(Continued)

FOREIGN PATENT DOCUMENTS

CN 103672614 A 3/2014
CN 103823321 A 5/2014
(Continued)

OTHER PUBLICATIONS

English translation of the International Search Report and Written Opinion of the International Searching Authority dated Feb. 15, 2019 for corresponding International Application No. PCT/CN2018/100954, filed Aug. 17, 2018.
(Continued)

*Primary Examiner* — Anabel Ton
(74) *Attorney, Agent, or Firm* — Mai-Tram D. Lauer; Westman, Champlin & Koehler, P.A.

(57) ABSTRACT

Provided are a surface light emitting module for an LED light source, a vehicle lamp using the same, and a method of assembling the same, so as to solve the technical problem that the existing LED light emitting module cannot achieve uniform lighting and cannot be used for the high brightness function as a brake lamp, a turn signal lamp, or the like. The surface light emitting module for an LED light source described in the present disclosure comprises: a back plate, a light guide plate, and an optical film disposed sequentially from back to front; and specifically, an LED light source and a PCB are disposed on a side of the light guide plate, and a
(Continued)

plurality of concave/convex microstructures are disposed at intervals on the light guide plate.

17 Claims, 4 Drawing Sheets

(51) Int. Cl.

| | |
|---|---|
| ***F21S 43/245*** | (2018.01) |
| ***F21S 43/241*** | (2018.01) |
| ***F21V 19/00*** | (2006.01) |
| *F21Y 115/15* | (2016.01) |
| *F21W 103/10* | (2018.01) |
| *F21W 103/35* | (2018.01) |

(52) U.S. Cl.
CPC ..... *F21V 19/0025* (2013.01); *F21W 2103/10* (2018.01); *F21W 2103/35* (2018.01); *F21Y 2115/15* (2016.08)

(56) References Cited

U.S. PATENT DOCUMENTS

2008/0106898 A1* 5/2008 Park ..... G02F 1/133603 362/235
2008/0266902 A1* 10/2008 Zheng ..... G02B 6/0041 362/618
2015/0160407 A1 6/2015 Hsiao et al.
2015/0168634 A1* 6/2015 Lu ..... G02B 6/0031 362/606
2015/0177444 A1* 6/2015 Saito ..... G02B 5/045 362/606
2015/0192731 A1* 7/2015 Kim ..... G02B 6/0045 362/628

FOREIGN PATENT DOCUMENTS

| | | | |
|---|---|---|---|
| CN | 104197240 | A | 12/2014 |
| CN | 204287675 | U | 4/2015 |
| CN | 204945574 | U | 1/2016 |
| CN | 105676521 | A | 6/2016 |
| KR | 20080018329 | A | 2/2008 |

OTHER PUBLICATIONS

English translation of the International Preliminary Report on Patentability of the International Searching Authority dated Dec. 1, 2020 for corresponding International Application No. PCT/CN2018/100954, filed Aug. 17, 2018.
First Office Action, including search report, for Chinese Patent Application No. 201810893557.0, dated Mar. 29, 2019, 10 pages.
Second Office Action for Chinese Patent Application No. 201810893557.0, dated Jul. 29, 2019, 10 pages.
First Search Report for Chinese Patent Application No. 201810893557.0, dated Aug. 3, 2018, 2 pages.

* cited by examiner

SURFACE LIGHT EMITTING MODULE FOR LED LIGHT SOURCE, VEHICLE LAMP USING THE SAME, AND METHOD OF ASSEMBLING THE SAME

CROSS-REFERENCE TO RELATED APPLICATIONS

This application claims priority to Chinese Patent Application No. CN2018105542226, filed with the Chinese Patent Office on May 31, 2018, entitled "Surface Light Emitting Module for LED Light Source, and Vehicle Lamp Using the Same" and Chinese Patent Application No. CN2018108935570, filed with the Chinese Patent Office on Aug. 3, 2018, entitled "Surface Light Emitting Module for LED Light Source, and Vehicle Lamp Using the Same", which are incorporated herein by reference in their entireties.

TECHNICAL FIELD

The present disclosure relates to the technical field of automobile lamps, and in particular to a surface light emitting module for an LED light source, a vehicle lamp using the same, and a method of assembling the same.

BACKGROUND ART

LED light sources have been used in automobile signal lamps for more than ten years, and all the advantages of the LED light sources have been substantially exploited with the development of several generations of vehicle models.

The current automobile industry has entered the era of intelligent network connection, and the fashion trend of the shape of automobiles has also developed into flatness, simplicity and 3D stereoscopy that conform to the characteristics of the intelligent network connection. The OLED technology appeared in the automobile lamp market three years ago. Its characteristics of ultra-thin sheet and uniform surface light emission have brought new possibilities to the shape of the vehicle lamp. However, so far, the OLED still has the problems of low yield of non-defective curved screens, the limited highest brightness, and high cost, and therefore large-scale application of the technology cannot be achieved.

Moreover, the use of an LED light emitting module with relatively low cost has the problem that uniform light emission cannot be achieved, and the high brightness function when used as a brake lamp, a turn signal lamp, or the like cannot be achieved.

Therefore, how to provide a light emitting module capable of achieving an effect of uniform surface light emission and having an ultra-thin, curved surface shape has become a technical problem to be solved urgently by those skilled in the art.

SUMMARY

An object of embodiments of the present disclosure is to provide a surface light emitting module for an LED light source and a vehicle lamp using the same, so as to solve the technical problem that the existing LED light emitting modules cannot achieve uniform light emission and cannot be used for high brightness functions as a brake lamp, a turn signal lamp, and the like.

An embodiment of the present disclosure provides a surface light emitting module for an LED light source, comprising: a back plate, a light guide plate, and an optical film which are disposed sequentially from back to front; wherein an LED light source and a PCB (printed circuit board) are disposed on a side of the light guide plate, and a plurality of concave/convex microstructures are disposed at intervals on the light guide plate.

Here, the optical film is in the form of a prism film.

Further, the optical film comprises: a prism film and a diffusion film; wherein the diffusion film is disposed on a bottom layer of the prism film; or the diffusion film comprises two layers, and the prism film is disposed between the two layers of the diffusion film.

Alternatively, the optical film comprises: an light filtering film, a prism film, and a diffusion film; wherein the diffusion film comprises two layers, the prism film is disposed between the two layers of the diffusion film, and the light filtering film is disposed on an outermost layer away from the light guide plate.

Still further, the prism film is in the form of a single-layer prism film; or the prism film is in the form of a double-layer prism film, and prism patterns on two layers of the prism film are arranged at 10 to 90 degrees to one another.

In a practical application, the concave/convex microstructures on the light guide plate are in the form of any one of a concave-convex hemisphere, a concave-convex V-shaped groove, a concave-convex cylinder, a concave-convex pyramid type, and a concave-convex freeform V-shaped groove; or the light guide plate is in the form of a plate with a structure of concave-convex freeform curved surface.

Here, the plurality of concave/convex microstructures disposed at intervals are in form of any one of a rectangular lattice distribution, a hexagonal lattice distribution, and a circular distribution.

Specifically, the light guide plate is made of PMMA (polymethyl methacrylate) or a PC (polycarbonate) material with high light transmittance.

Further, the back plate is used for specular reflection or white diffusion reflection, or plated with textured aluminum.

The present disclosure also provides a surface light emitting module for an LED light source, comprising: a back plate and a light guide plate; an LED light source and a PCB being mounted on a side of the light guide plate, wherein the PCB is connected to the LED light source for controlling on/off of the LED light source; and the back plate is disposed on a bottom surface of the light guide plate, and a plurality of concave/convex microstructures are disposed at intervals on the light guide plate, wherein the concave/convex microstructures are distributed and disposed on the light guide plate depending on a light extraction efficiency and a uniformity of LED lighting points.

Optionally, in the present embodiment, the surface light emitting module for an LED light source further comprises: an optical film;

the optical film is disposed on a top surface of the light guide plate.

The present disclosure also provides a vehicle lamp, comprising: a surface light emitting module for an LED light source according to any one of aspects described above; and a housing disposed outside the surface light emitting module for an LED light source.

An embodiment of the present disclosure also provides a method of assembling the above-mentioned surface light emitting module for an LED light source described above, the method further including following steps:

mounting an LED light source and a PCB on a side of a light guide plate;

mounting the light guide plate on a back plate; and making an optical film cover a side of the light guide plate away from the back plate.

In the present embodiment, the step of making an optical film cover a side of the light guide plate away from the back plate includes:

using a double-sided tape to make a single-layer or multilayer optical film cover the side of the light guide plate away from the back plate.

Compared with the prior art, the technical solutions according to the embodiments of the present disclosure have the following advantages:

The surface light emitting module for an LED light source, the vehicle lamp using the same, and the method of assembling the same according to the embodiments of the present disclosure, comprise a back plate, a light guide plate, and an optical film which are disposed sequentially from back to front; and specifically, an LED light source and a PCB are disposed on a side of the light guide plate, and a plurality of concave/convex microstructures are disposed at intervals on the light guide plate. As can be seen from the analysis, in the surface light emitting module for an LED light source provided in the present disclosure, due to the provision of the optical film, an effect of uniform surface light emission can be achieved; since the LED light source and the PCB are disposed on a side of the light guide plate, an ultra-thin (about 2 mm) structure can be realized; and since a plurality of concave/convex microstructures are disposed at intervals on the light guide plate, a curved surface shape can be formed. In addition, the surface light emitting module for an LED light source according to the present disclosure can be applied to automobile signal lamps, meet the demands for functions of a tail lamp, a brake lamp, and a turn signal lamp, and has a spatial stereoscopic luminous effect.

The present disclosure also provides a vehicle lamp, comprising: a surface light emitting module for an LED light source according to any one of aspects described above; and a housing disposed outside the surface light emitting module for an LED light source.

The advantages of the vehicle lamp over the prior art are the same as those of the above-mentioned surface light emitting module for an LED light source described above, and therefore are not described repeatedly here.

BRIEF DESCRIPTION OF DRAWINGS

In order to illustrate technical solutions of embodiments of the present disclosure more clearly, drawings required for use in the embodiments will be introduced briefly below. It should be understood that the drawings below are merely illustrative of some embodiments of the present disclosure, and therefore should not be considered as limiting its scope. It would be understood by those of ordinary skill in the art that other relevant drawings could also be obtained from these drawings without any inventive effort.

In the figures: 1—back plate; 2—light guide plate; 3—optical film; 4—LED light source; 21—concave/convex microstructure; 31—prism film; 32—diffusion film; 33—light filtering film.

DETAILED DESCRIPTION OF EMBODIMENTS

The technical solutions of the present disclosure will be described clearly and completely below with reference to the accompanying drawings. It is apparent that the embodiments to be described are some, but not all of the embodiments of the present disclosure. All the other embodiments obtained by those of ordinary skill in the art in light of the embodiments of the present disclosure without inventive efforts should fall within the scope of the present disclosure as claimed.

In the description of the present disclosure, it should be noted that orientation or positional relations indicated by the terms such as "center", "up", "down", "left", "right", "vertical", "horizontal", "inside", and "outside" are the orientation or positional relations shown based on the figures, and these terms are intended only to facilitate the description of the present disclosure and simplify the description, but not intended to indicate or imply that the referred devices or elements must be in a particular orientation or constructed or operated in the particular orientation, and therefore should not be construed as limiting the present disclosure. In addition, the terms "first", "second", and "third" are used for descriptive purpose only, and should not be understood as an indication or implication of relative importance.

In the description of the present disclosure, it should be noted that the terms "mounted", "coupled", and "connected" should be understood in a broad sense unless otherwise expressly specified or defined. For example, a connection may be a fixed connection or a detachable connection or an integral connection, may be a mechanical connection or an electric connection, or may be a direct coupling or an indirect coupling via an intermediate medium or an internal communication between two elements. The specific meanings of the above-mentioned terms in the present disclosure could be understood by those of ordinary skill in the art according to specific situations.

Figure 1:
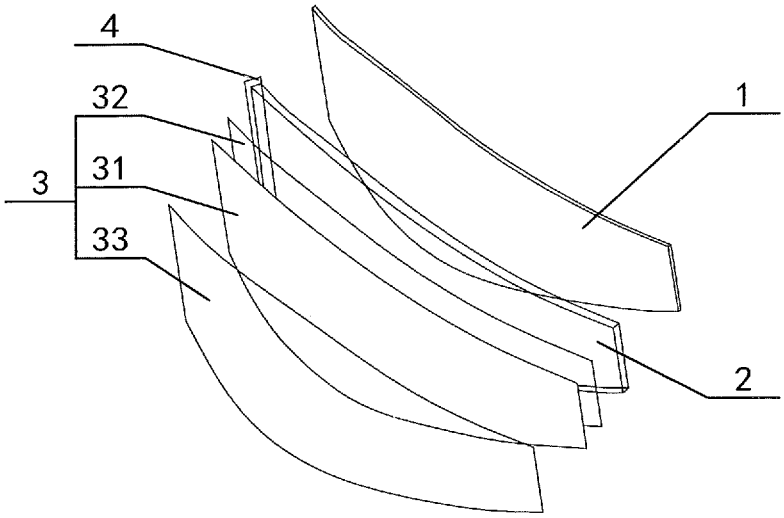
FIG. 1 is a schematic structural view of a surface light emitting module for an LED light source according to an embodiment of the present disclosure.
Figure 4:
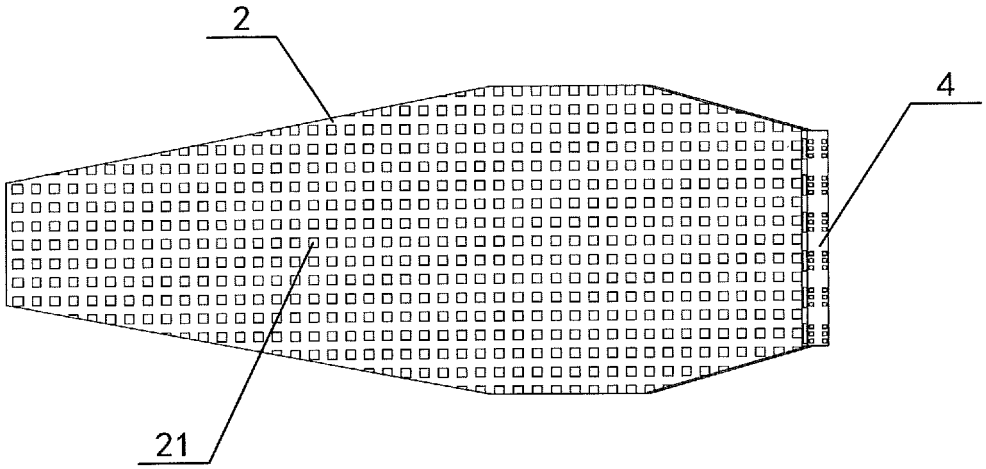
FIG. 4 is a schematic structural view of a light guide plate of a surface light emitting module for an LED light source according to an embodiment of the present disclosure.

FIG. 1 is a schematic structural view of a surface light emitting module for an LED light source according to an embodiment of the present disclosure; and FIG. 4 is a schematic structural view of a light guide plate of a surface light emitting module for an LED light source according to an embodiment of the present disclosure.

As shown in FIG. 1 in combination with FIG. 4, an embodiment of the present disclosure provides a surface light emitting module for an LED light source, comprising: a back plate 1, a light guide plate 2, and an optical film 3 which are disposed sequentially from back to front; an LED light source 4 and a PCB (not shown in figures) are disposed on a side of the light guide plate 2, and a plurality of concave/convex microstructures 21 are disposed at intervals on the light guide plate 2.

Compared with the prior art, the surface light emitting module for an LED light source described in the embodiment of the present disclosure has the following advantages:

The surface light emitting module for an LED light source according to the embodiment of the present disclosure, as shown in FIG. 1 in combination with FIG. 4, comprises a back plate 1, a light guide plate 2, and an optical film 3 disposed sequentially from back to front; and specifically, an LED light source 4 and a PCB (not shown in figures) are disposed on a side of the light guide plate 2, and the PCB is connected to the LED light source for controlling on/off of the LED light source. Moreover, a plurality of concave/convex microstructures 21 are disposed at intervals on the light guide plate 2. As can be seen from the analysis, in the surface light emitting module for an LED light source according to embodiments of the present disclosure, due to the provision of the optical film 3, an effect of uniform surface light emission can be achieved; since the LED light source 4 and the PCB are disposed on a side of the light guide plate 2, an ultra-thin (about 2 mm) structure can be realized; and since a plurality of concave/convex microstructures 21 are disposed at intervals on the light guide plate 2, a curved surface shape can be formed. In addition, the surface light emitting module for an LED light source according to embodiments of the present disclosure can be applied to automobile signal lamps, meet the demands for functions of a tail lamp, a brake lamp, and a turn signal lamp, and has a spatial stereoscopic luminous effect.

It should be additionally noted here that a prism film is named for its surface microstructures in the form of a prism, serves for improving the brightness, and is also called as a "brightness enhancement film" (BEF).

Figure 2:
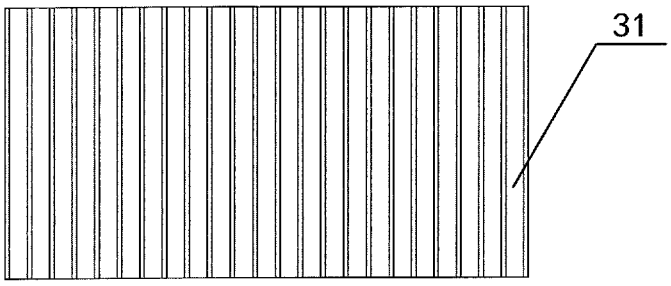
FIG. 2 is a schematic plan structural view of a prism film of a surface light emitting module for an LED light source according to an embodiment of the present disclosure.
Figure 3:
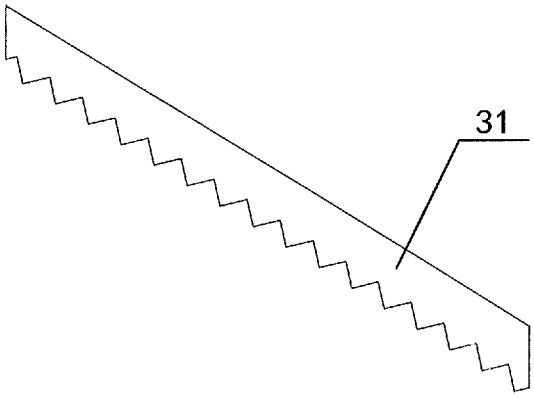
FIG. 3 is a schematic sectional structural view of a prism film of a surface light emitting module for an LED light source according to an embodiment of the present disclosure.

FIG. 2 is a schematic plan structural view of a prism film of a surface light emitting module for an LED light source according to an embodiment of the present disclosure; and FIG. 3 is a schematic sectional structural view of a prism film of a surface light emitting module for an LED light source according to an embodiment of the present disclosure.

Here, as shown in FIG. 2 and FIG. 3, the above-mentioned optical film 3 may be in the form of a prism film 31. The prism film 31 can be disposed to effectively improve the illumination efficiency of the surface light emitting module for an LED light source, so that it can be used as a brake lamp. The prism film 31 may include, but is not limited to, a horizontal prism film or a vertical prism film. The prism film 31 can serve for increasing the efficiency of the light distribution region by converging light beams within a certain angle, and has an external surface (front surface) with triangular microstructures, and a back surface which is a smooth surface; and the front surface is oriented toward the optical axis direction (light emitting direction) when in use.

Further, the above-mentioned optical film 3 may also comprise a prism film 31 and a diffusion film 32. In an implementation of the present embodiment, the diffusion film 32 may be disposed on a bottom layer of the prism film 31. In another implementation of the present embodiment, the diffusion film 32 may comprise two layers, and the prism film 31 may be disposed between the two layers of the diffusion film 32. This arrangement can effectively improve the illumination uniformity of the surface light emitting module for an LED light source. The diffusion film 32 can serve for smoothly diffusing light beams.

Alternatively, the above-mentioned optical film 3 may further comprise: a light filtering film 33, a prism film 31, and a diffusion film 32; wherein the diffusion film 32 may comprise two layers, the prism film 31 is disposed between the two layers of the diffusion film 32, and the light filtering film 33 is disposed on an outermost layer away from the light guide plate 2. The light filtering film 33 is a red transparent or yellow transparent thin film, and can change the apparent color of a light emitting area of the module in a non-lighting state.

Furthermore, the above-mentioned light filtering film 33 may be provided with a silhouette shape formed by a non-transparent figure, and thus a transparent figure distinguished from the base color can be obtained to increase the gradations (sense of depth) of the brightness of the light emitting surface.

Still further, the above-mentioned prism film 31 may be in the form of a single-layer prism film; or the above-mentioned prism film 31 may be in the form of a double-layer prism film. When it is a double-layer prism film, prism patterns on the two layers of the prism film 31 are arranged at 10 to 90 degrees to one another. When the prism patterns on the two layers of the prism film are placed at 90 degrees to one another, that is, one layer of the prism film 31 is a horizontal prism film, and the other layer of the prism film 31 is a vertical prism film.

It should be additionally noted here that, in the present embodiment, the number of layers of the optical film 3 may be either greater than or equal to 0, and the use of a three-layer film as the optical film 3 is only an embodiment according to the present disclosure, and should not be understood as limiting the scope of protection of the present disclosure. For example, in other embodiments of the present disclosure, when the optical film 3 comprises the prism film 31, the diffusion film 32, and the light filtering film 33, they may be repeatedly superposed and used as needed; and the prism film 31 may also be selected from type of one layer or two layers.

The arrangement of the optical film 3 is not limited to one form and may include (from top to bottom):

A. the diffusion film 32, the (horizontal) prism film 31, and the diffusion film 32;
B. the diffusion film 32, the (horizontal) prism film 31, the (vertical) prism film 31, and the diffusion film 32;
C. the (horizontal) prism film 31;
D. the (horizontal) prism film 31, and the (vertical) prism film 31;

E. the (horizontal) prism film 31, and the diffusion film 32;

F. the (red, yellow, or grey) light filtering film 33, the diffusion film 32, the (vertical) prism film 31, the (horizontal) prism film 31, and the diffusion film 32.

The structure of the entire surface light emitting module for an LED light source will be introduced below by taking the form A of the optical film 3 as an example. Correspondingly, reference may be made to FIG. 1 again. In FIG. 1, an LED light source 4 and a PCB (not shown in figures) is mounted on a lateral side of the light guide plate 2, wherein the PCB is connected to the LED light source 4 for controlling on/off of the LED light source 4. The back plate is disposed at a bottom surface of the light guide plate 2, the back plate is configured to reflect LED light emitted from the bottom surface of the light guide plate, and a plurality of concave/convex microstructures are disposed at intervals on the light guide plate 2, wherein the concave/convex microstructures are distributed and disposed on the light guide plate 2 depending on a light extraction efficiency and a uniformity of the LED lighting points. The optical film 3 comprises a prism film 31 and two diffusion films 32. One of the diffusion films 32 is disposed at a top surface of the light guide plate, the prism film 31 is disposed on this diffusion film 32, and the other diffusion film 32 is disposed on the prism film 31, that is to say, in the present embodiment, the prism film 31 is sandwiched between the diffusion films 32. The LED light emitted from the LED light source is emitted from the top surface of the light guide plate 2 under the action of the light guide plate 2 and the back plate 1, and the LED light emitted from the top surface of the light guide plate 2 forms a light emitting surface after being processed by the optical film 3.

The above description is only one implementation of the present disclosure. It can be understood that, in other implementations of the present embodiment, the structure of the optical film 3 may be adjusted according to actual needs to meet different needs.

Figure 5:
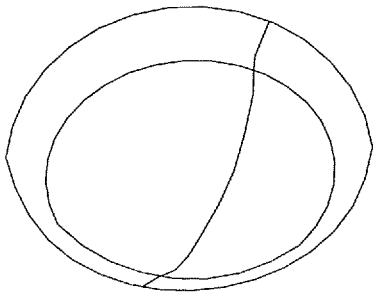
FIG. 5 is a schematic structural view of a first concave/convex microstructure on a light guide plate of a surface light emitting module for an LED light source according to an embodiment of the present disclosure.
Figure 6:
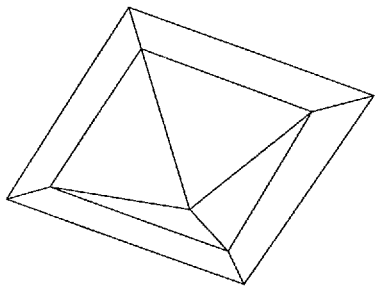
FIG. 6 is a schematic structural view of a second concave/convex microstructure on a light guide plate of a surface light emitting module for an LED light source according to an embodiment of the present disclosure.
Figure 7:
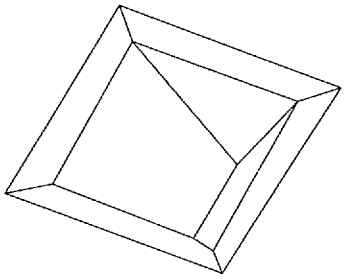
FIG. 7 is a schematic structural view of a third concave/convex microstructure on a light guide plate of a surface light emitting module for an LED light source according to an embodiment of the present disclosure.

FIG. 5 is a schematic structural view of a first concave/convex microstructure on a light guide plate of a surface light emitting module for an LED light source according to an embodiment of the present disclosure; FIG. 6 is a schematic structural view of a second concave/convex microstructure on a light guide plate of a surface light emitting module for an LED light source according to an embodiment of the present disclosure; FIG. 7 is a schematic structural view of a third concave/convex microstructure on a light guide plate of a surface light emitting module for an LED light source according to an embodiment of the present disclosure; and FIG. 8 is a schematic structural view of a fourth concave/convex microstructure on a light guide plate of a surface light emitting module for an LED light source according to the embodiment.

Figure 8:
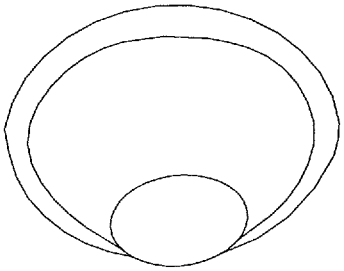
FIG. 8 is a schematic structural view of a fourth concave/convex microstructure on a light guide plate of a surface light emitting module for an LED light source according to an embodiment of the present disclosure.

In a practical application, as shown in FIG. 4 in combination with FIG. 5 to FIG. 8, the concave/convex microstructures 21 on the above-mentioned light guide plate 2 may be in the form of any one of a concave-convex hemisphere (as shown in FIG. 5), a concave-convex pyramid type (as shown in FIG. 6), a concave-convex V-shaped groove (as shown in FIG. 7), a concave-convex cylinder (as shown in FIG. 8), and a concave-convex freeform V-shaped groove; or the above-mentioned light guide plate 2 may be directly in the form of a plate with a structure of concave-convex freeform curved surface.

Figure 9:
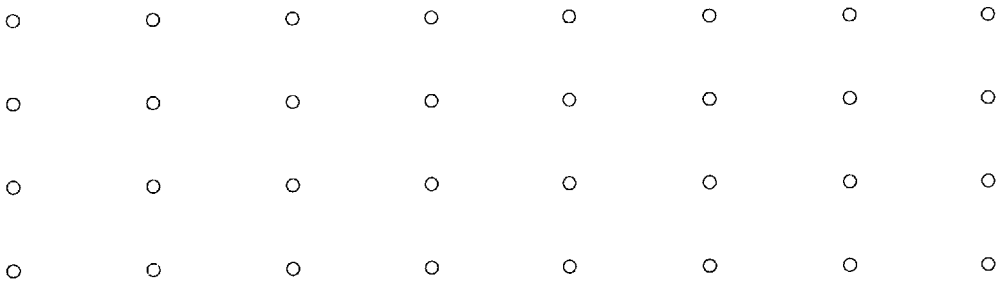
FIG. 9 is a schematic structural view of a first distribution of concave/convex microstructures on a light guide plate of a surface light emitting module for an LED light source according to an embodiment of the present disclosure.
Figure 10:
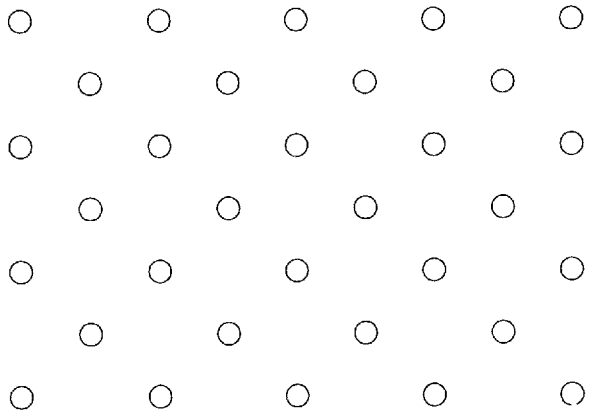
FIG. 10 is a schematic structural view of a second distribution of concave/convex microstructures on a light guide plate of a surface light emitting module for an LED light source according to an embodiment of the present disclosure.

FIG. 9 is a schematic structural view of a first distribution of concave/convex microstructures on a light guide plate of a surface light emitting module for an LED light source according to an embodiment of the present disclosure; FIG. 10 is a schematic structural view of a second distribution of concave/convex microstructures on a light guide plate of a surface light emitting module for an LED light source according to an embodiment of the present disclosure; and FIG. 11 is a schematic structural view of a third distribution of concave/convex microstructures on a light guide plate of a surface light emitting module for an LED light source according to an embodiment of the present disclosure.

Figure 11:
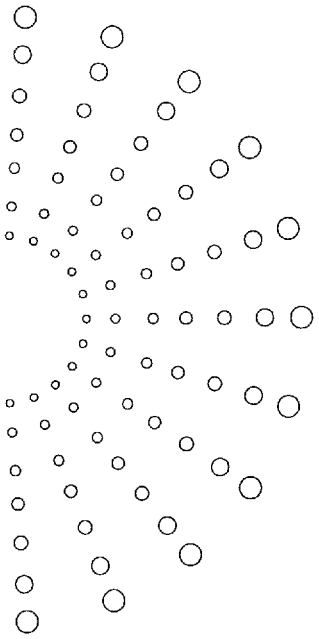
FIG. 11 is a schematic structural view of a third distribution of concave/convex microstructures on a light guide plate of a surface light emitting module for an LED light source according to an embodiment of the present disclosure.

Here, as shown in FIG. 9 to FIG. 11, a plurality of concave/convex microstructures 21 disposed at intervals may be in form of any one of a rectangular lattice distribution (as shown in FIG. 9), a rhombic lattice distribution (as shown in FIG. 10), and a radial distribution (as shown in FIG. 11).

It should be additionally noted here that the concave/convex microstructures 21 on the light guide plate 2 may be designed with some rules depending on the requirements on the light extraction efficiency and the uniformity of lighting points, and may vary in size, arrangement spacing, and angle of the pattern. The specific arrangement may be made as follows:

a. the spacing is fixed, and the size of the pattern varies: the minimum spacing between lattice points is set to a fixed value, and the rule of variation in pattern diameter parameter y approximates a function $y=a_1^x-1(x>0, a_1>1)$ passing the origin point, and the actual distribution is calculated by an iterative function;

b. the spacing varies, and the pattern size is invariable: the pattern size is set to a fixed value, the rule of variation in pattern spacing parameter y approximates the function $y=a_2^x-1(x>0, a_2>1)$ passing the origin point, and the actual distribution is calculated by an iterative function;

c. the spacing varies, and the pattern size varies: the variations in both lattice point spacing and pattern size approximate the function $y=a_3^x-1(x>0, a_3>1)$ passing the origin point, and the actual distribution is calculated by an iterative function.

Further, when the concave/convex microstructure 21 is a V-shaped groove, the pattern in the V-shaped groove has an angle varying with the curvature of the optical surface to maintain the optical efficiency.

Specifically, the above-mentioned light guide plate 2 may be made of PMMA or a PC (PCLED2045, PC LC-1500, or the like) material with high light transmittance.

It should be additionally noted here that when the light guide plate 2 is made of a PMMA series material, a design without an optical structure may be used, that is to say, the light guide plate 2 is not provided with a concave/convex microstructure 21.

Further, the above-mentioned back plate 1 may be used for either specular reflection or white diffuse reflection. In order to achieve the above-mentioned specular reflection or white diffuse reflection, an aluminum-plated textured layer may be plated on the back plate, or a layer of other material without high reflectivity may be plated on the back plate.

It should be additionally noted here that if the back plate 1 is not used for specular reflection and white diffuse reflection, it is necessary to add a reflective film in front of the back plate 1 (behind the light guide plate 2). The reflective film is used for specular reflection or white diffuse reflection.

The assembly of the surface light emitting module for an LED light source according to embodiments of the present disclosure will be described in detail below with reference to the accompanying drawings.

As shown in FIG. 1, first, a LED light source 4 and a PCB are mounted on a side of the light guide plate 2;

next, the light guide plate 2 is mounted on a back plate 1, wherein the bottom surface of the light guide plate 2 is opposite to the back plate 1;

finally, a double-sided tape is attached to a side of the light guide plate 2 away from the back plate 1 (i.e., the top surface of the light guide plate 2), and then the light guide plate 2 is covered with a single-layer or multilayer optical film 3 by the double-sided tape.

The embodiment of the present disclosure further provides a vehicle lamp, comprising: a surface light emitting module for an LED light source according to any one of the embodiments described above, and a housing disposed outside the surface light emitting module for an LED light source.

Here, the above-mentioned housing may be wrapped with a metal stamped frame or a plastic shell.

According to the surface light emitting module for an LED light source, the vehicle lamp using the same, and the method of assembling the same according to the embodiments of the present disclosure, an ultra-thin surface light source module can be implemented (the main contribution of the ultra-thinness is that the design of light guide plate with lateral incidence, and the optical film is superposed to improve the optical efficiency and present a uniform light emission), it has a high degree of freedom of stacking and arrangement in space, and it is easy to obtain a stereoscopic lighting effect; the surface light emitting part has undergone precise optical design (a plurality of concave/convex microstructures distributed at intervals on the light guide plate), so that an orientational high-efficient light emitting mode can be achieved to meet the high brightness function of a brake lamp, a turn signal lamp or the like; in addition, it is also possible to focus on the lighting effect to achieve a tail lamp mode with uniformity at the level of an OLED.

The above description is merely illustrative of preferred embodiments of the present disclosure and is not intended to limit the present disclosure. Any modifications, equivalent alternatives, improvements and so on made within the spirit and principle of the present disclosure are to be included in the scope of protection of the present disclosure.

INDUSTRIAL APPLICABILITY

The surface light emitting module for an LED light source, the vehicle lamp using the same, and the method of assembling the same according to the embodiments of the present disclosure can be applied to automobile signal lamps, meet the functions of a tail lamp, a brake lamp, and a turn signal lamp, and have a spatial stereoscopic luminous effect.

The invention claimed is:

1. A surface light emitting module for an LED light source, comprising:

a back plate, a light guide plate, and an optical film which are disposed sequentially from back to front, an LED light source and a PCB (printed circuit board) disposed on a side of the light guide plate, and a plurality of concave or convex microstructures disposed at intervals on the light guide plate, wherein the plurality of concave or convex microstructures disposed at intervals are in a form of any one of a rectangular lattice distribution, a hexagonal lattice distribution, and a circular distribution, and wherein an aluminum-plated textured layer is plated on the back plate, or a material without high reflectivity is plated on the back plate.

2. The surface light emitting module for an LED light source according to claim 1, wherein the optical film is in a form of a prism film.

3. The surface light emitting module for an LED light source according to claim 1, wherein the optical film comprises: a prism film and a diffusion film;

the diffusion film is disposed on a bottom layer of the prism film; or the diffusion film comprises two layers, and the prism film is disposed between the two layers of the diffusion film.

4. The surface light emitting module for an LED light source according to claim 1, wherein the optical film comprises: a light filtering film, a prism film, and a diffusion film; and the diffusion film comprises two layers, the prism film is disposed between the two layers of the diffusion film, and the light filtering film is disposed on an outermost layer away from the light guide plate.

5. The surface light emitting module for an LED light source according to claim 2, wherein the prism film is in a form of a single-layer prism film; or the prism film is in a form of a double-layer prism film, and prism patterns on two layers of the prism film are arranged at 10 to 90 degrees to one another.

6. The surface light emitting module for an LED light source according to claim 1, wherein the concave or convex microstructures on the light guide plate are in a form of any one of a concave or convex hemisphere, a concave or convex V-shaped groove, a concave or convex cylinder, a concave or convex pyramid type, and a concave or convex freeform V-shaped groove; or the light guide plate is in a form of a plate with a structure of concave or convex freeform curved surface.

7. The surface light emitting module for an LED light source according to claim 1, wherein the light guide plate is made of PMMA (polymethyl methacrylate) or a PC (polycarbonate) material with high light transmittance.

8. A vehicle lamp, comprising:

a surface light emitting module for an LED light source comprising:

a back plate, a light guide plate, and an optical film which are disposed sequentially from back to front, an LED light source and a PCB (printed circuit board) disposed on a side of the light guide plate, a plurality of concave or convex microstructures disposed at intervals on the light guide plate; and a housing disposed outside the surface light emitting module for the LED light source.

9. The surface light emitting module for an LED light source according to claim 1, wherein the PCB is connected to the LED light source for controlling on/off of the LED light source; and the back plate is disposed on a bottom surface of the light guide plate, and the concave or convex microstructures are distributed and disposed on the light guide plate depending on a uniformity of LED lighting points and a light extraction efficiency.

10. The surface light emitting module for an LED light source according to claim 9, wherein the optical film is disposed on a top surface of the light guide plate.

11. A method of assembling a surface light emitting module for an LED light source comprising a back plate, a light guide plate, and an optical film which are disposed sequentially from back to front; an LED light source and a PCB (printed circuit board) disposed on a side of the light guide plate, and a plurality of concave or convex microstructures disposed at intervals on the light guide plate; wherein the plurality of concave or convex microstructures disposed at intervals are in a form of and one of a rectangular lattice distribution, a hexagonal lattice distribution, and a circular distribution, the method further comprising steps of:

mounting an LED light source and a PCB on a side of the light guide plate;

mounting the light guide plate on the back plate; and making an optical film cover a side of the light guide plate away from the back plate;

wherein the concave or convex microstructures on the light guide plate are in a form of an one of a concave or convex hemisphere, a concave or convex V-shaped groove, a concave or convex cylinder, a concave or convex pyramid type, and a concave or convex free-form V-shaped groove, the light guide plate is in a form of a plate with a structure of concave or convex freeform curved surface.

12. The method of assembling according to claim 11, wherein the step of making an optical film cover a side of the light guide plate away from the back plate comprises:

using a double-sided tape to make a single-layer or multilayer optical film cover the side of the light guide plate away from the back plate.

13. The surface light emitting module for an LED light source according to claim 3, wherein the prism film is in a form of a single-layer prism film; or the prism film is in a form of a double-layer prism film, and prism patterns on two layers of the prism film are arranged at 10 to 90 degrees to one another.

14. The surface light emitting module for an LED light source according to claim 4, wherein the prism film is in a form of a single-layer prism film; or the prism film is in a form of a double-layer prism film, and prism patterns on two layers of the prism film are arranged at 10 to 90 degrees to one another.

15. The surface light emitting module for an LED light source according to claim 6, wherein the light guide plate is made of PMMA or a PC material with high light transmittance.

16. The surface light emitting module for an LED light source according to claim 6, wherein the light guide plate is made of PMMA or a PC material with high light transmittance.

17. The method of assembly according to claim 11, comprising plating an aluminum-plated textured layer on the back plate, or plating a material without high reflectivity on the back plate.

* * * * *